US006763954B1

(12) United States Patent
Travers et al.

(10) Patent No.: US 6,763,954 B1
(45) Date of Patent: Jul. 20, 2004

(54) DISH DRAINER AND TRAY SYSTEM WITH COMPACT STORAGE OF THE TRAY

(75) Inventors: John F. Travers, Parma, OH (US); Vince Haley, Orrville, OH (US); Sean Michael O'Brien, Wooster, OH (US); Christopher Gilbert, Moreland Hills, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 09/649,399

(22) Filed: Aug. 28, 2000

(51) Int. Cl.[7] ..... A47G 19/08
(52) U.S. Cl. ..... 211/41.3; 211/41.6
(58) Field of Search ..... 211/41.1–41.3, 211/41.5–41.6, 132.1, 195; D32/55–59; 206/557, 503, 505, 507, 541, 549; 220/23.83, 23.86–23.89, 572, 487–488; 190/12 A, 12 R

(56) References Cited

U.S. PATENT DOCUMENTS

| | | | | | |
|---|---|---|---|---|---|
| 623,366 | A | * | 4/1899 | Cleek | 220/529 |
| 725,825 | A | * | 4/1903 | Halvorsen | 220/572 |
| 1,476,389 | A | * | 12/1923 | Blank | 190/12 R |
| 1,522,921 | A | | 1/1925 | Smiley | |
| 1,660,210 | A | * | 2/1928 | Schaefer | 211/41.6 |
| 1,712,342 | A | * | 5/1929 | Fitzgerald | 211/41.6 |
| 1,714,629 | A | | 5/1929 | Rodin | |
| 1,835,232 | A | | 12/1931 | Lord | |
| 2,151,068 | A | * | 3/1939 | Atlas | 211/41.1 |
| 2,301,630 | A | * | 11/1942 | Krienitz | 190/12 R |
| 2,321,703 | A | * | 6/1943 | Rivard | 126/261 |
| 2,443,404 | A | | 6/1948 | Tallarico | |
| 2,592,032 | A | | 4/1952 | Henderson | 311/21 |
| 2,708,037 | A | * | 5/1955 | Planeta | 211/41.6 |
| 3,025,967 | A | | 3/1962 | Christophersen | |

(List continued on next page.)

FOREIGN PATENT DOCUMENTS

| | | |
|---|---|---|
| BE | 462 171 | 1/1946 |
| DE | 30 35 971 A1 | 5/1982 |
| DE | 199 07 194 A1 | 8/2000 |

*Primary Examiner*—Jennifer E. Novosad
(74) *Attorney, Agent, or Firm*—Marshall, Gerstein & Borun LLP

(57) ABSTRACT

A dish drainer and tray system providing reduced space requirements for packaging, shipping, display and storage. The tray may be compacted into storage size which allows it to fit in the drainer, thereby allowing the drainer rather than the combination to determine the space requirements. In one embodiment, the tray folds about one or more live hinges, and in a second embodiment the tray rolls and includes a closure to maintain it in the rolled position. A particularly preferred embodiment includes a detachable silverware compartment that drains directly into the sink and which can be stored with the tray in the drainer.

9 Claims, 5 Drawing Sheets

U.S. PATENT DOCUMENTS 3,800,957 A 4/1974 Krause
4,169,638 A 10/1979 Cirasuolo et al.
D271,339 S * 11/1983 Lee ..... D32/55
4,527,707 A * 7/1985 Heymann et al. ..... 211/74
4,531,641 A * 7/1985 Archambault ..... 211/41.1
4,640,392 A * 2/1987 Decker et al. ..... 190/102
4,884,714 A * 12/1989 Bechtel ..... 211/41.1
4,947,984 A * 8/1990 Kaufman et al. ..... 206/44.12
4,958,577 A 9/1990 Demaio et al. ..... 108/43
5,105,485 A 4/1992 Sciabarassi
5,119,943 A * 6/1992 Hoang ..... 211/41.1
5,119,947 A * 6/1992 Stewart ..... 211/71
5,158,184 A * 10/1992 Craft et al. ..... 211/41.1
5,242,054 A * 9/1993 Todd ..... 206/497
D353,921 S * 12/1994 Lippisch et al. ..... D32/55
D365,182 S 12/1995 Zehrung
5,485,927 A * 1/1996 Hubbard ..... 211/41.1
5,595,302 A * 1/1997 Maydwell et al. ..... 190/109
5,637,263 A 6/1997 Lang et al. ..... 261/94
5,704,492 A * 1/1998 Bartko ..... 211/41.1
5,711,210 A * 1/1998 Kaufman ..... 99/340
D398,725 S * 9/1998 Merkel ..... D32/55
5,893,718 A * 4/1999 O'Donnell ..... 434/128
5,934,486 A * 8/1999 Jarvis et al. ..... 211/41.8
6,170,676 B1 * 1/2001 Patadia et al. ..... 211/41.6
6,179,134 B1 * 1/2001 Pine et al. ..... 211/41.3
2002/0056717 A1 * 5/2002 Hwang ..... 220/835

* cited by examiner

DISH DRAINER AND TRAY SYSTEM WITH COMPACT STORAGE OF THE TRAY

CROSS-REFERENCE TO RELATED APPLICATIONS

NONE

BACKGROUND OF THE INVENTION

1. Field of the Invention

The present invention relates generally to the field of kitchen accessories and more particularly to dish drainers and trays. In its most specific embodiments, the present invention relates to a dish drainer —tray system, the tray being constructed and arranged to be compacted into a size to fit within the drainer for packaging, shipment, in-store display and for storage by the end user.

2. Description of the Prior Art

Many different types of dish drainer and tray systems are know in the art. Some include the capability of folding to reduce storage space requirements. For example, folding dish drainers are disclosed in U.S. Pat. No. 3,800,957 issued Apr. 2, 1974 to Krause for "Combination Dish Rack and Tray" and U.S. Pat. No. 3,025,967 issued Mar. 20,1962 to Christophersen and entitled "Dish Drying Rack". Folding dish drainers which include a drain board include U.S. Pat. No. 2,443,404 issued Jun. 15, 1948 to Tallarico for "Drain Board for Dishes" and U.S. Pat. No. 1,835,232 issued Dec. 8, 1931 to Lord for "Dish Drainer".

Dish trays themselves are also well known and may be used without dish draining racks. This is generally considered to be preferable to simply drying dishes or other kitchenware on a dish towel, as is common practice in many households. Trays are shown in U.S. Pat. No. D365,182 issued Dec. 12, 1995 to Zehrung for "Dish Drain Tray", U.S. Pat. No. 5,105,485 issued Apr. 21, 1992 to Sciabarassi for "Drain Board", and U.S. Pat. No. 1,522,921 issued Jan. 13, 1925 to Smiley for "Dish Mat". The latter includes a coupling between individual mat portions to allow them to fold.

A folding dish rack is also shown in U.S. Pat. No. 1,714,629 issued May 28, 1929 to Rodin for "Folding Dish Rack". This device includes a framework and several pivotal elements which may be elevated from horizontal to vertical positions depending on the desired use.

Finally, a dish draining system is disclosed in U.S. Pat. No. 4,169,638 issued Oct. 2, 1979 to Cirasuuolo et al. for "Drainboard—Extend-A-Drain". In this device, the tray may be stored within a housing and be extended over the sink when in use, as best appreciated from FIGS. 7 and 8 of this patent.

While the above-referenced patents show a variety of prior attempts to reduce storage space requirements for certain dish draining equipment, the systems are not applicable to tough, durable, plastic dish drainer and tray sets, which employ a tray that has a footprint larger than that of the base of the drainer. Such combinations are frequently sold as sets, and for packaging and sale, it is necessary to package the combination in a container, such as a folding carton or corrugated package, which accommodate the component having the largest dimensions, i.e. the tray. Accordingly, a considerable amount of wasted cube results, leading to logistical problems. For example, fewer packages can be transported on a pallet or in a truck, and fewer products can be displayed in a given space on a store shelf.

Consumers are also faced with the need to store both the tray and drainer, since typically these devices are placed on a counter adjacent a sink only after meal times and are left out until the items placed in the drainer have dried completely. Once again, the footprint of the tray typically dictates the storage space required for the set, or the individual components can be separately stored horizontally or vertically in the most convenient location in the users kitchen.

A dish drainer and tray system which could be packaged, shipped and displayed for sale in less space and which could be stored by the consumer in less space, while maintaining the desirable features of toughness and durability, would be a significant advance in this art.

FEATURES AND SUMMARY OF THE INVENTION

The present invention features a combination dish drainer and tray system in which the tray has a footprint sufficiently large to in accommodate the drainer in a first configuration and may be compacted to a second configuration for storage within the drainer itself.

Another feature of the present invention is to provide a dish drainer and tray system in which a tough, durable drainer may be employed with a foldable or rollable tray to reduce the space required to package, ship, display, and store the two components.

A different feature of the present invention is to provide a dish drainer tray which may be folded using live hinges to a sufficiently small size to allow it to fit within a dish drainer.

A still further feature of the present invention is to provide a dish drainer tray which may be rolled and secured in the rolled position.

A different feature of the present invention is to provide a silverware container which may be releasable attached to a dish drainer tray which may be compacted by rolling or folding so that the dish drainer can accommodate both the tray and the silverware container.

How these and other features of the present invention, either singly or in any combination, are accomplished will become apparent in the following detailed description of the preferred embodiments, taken in conjunction with the FIGURES. Generally, however, they are provided in a system which includes a dish drainer which may have any desired shape and structure to receive kitchenware, dishes, glasses and the like for drying and which has a base. The system further includes a tray which has a footprint which exceeds the base of the dish drainer and is adapted to receive water from articles placed in the drainer and to guide it toward a sink. In the present invention, the tray may be compacted, such as by rolling or folding, to a configuration to allow it to fit within the drainer. In the preferred embodiments disclosed below, folding is preferentially accomplished using live hinges, while rolling is preferentially accomplished by rolling a flexible tray and self-locking it in the rolled-up position for easy storage within the drainer. In a particularly preferred embodiment, a detachable silverware container is provided and may be coupled to the tray when in use and may be detached therefrom for storage within the drainer. Other ways in which the above-mentioned and other features of the invention are accomplished, will become apparent to those skilled in the art after they have read this specification. All such ways are deemed to fall within the scope of the present invention, if they fall within the scope of the claims which follow.

DETAILED DESCRIPTION OF THE PREFERRED EMBODIMENTS

Before proceeding to the detailed description of the preferred embodiment, several general comments can be made about the applicability and the scope of the present invention. First, the particular shape and functionality of the dish drainer is not a limiting feature of the invention, and any known dish drainer can be employed. In its most preferred embodiments, the dish drainer itself is an integral molding made from a synthetic resin and has a generally rectangular profile. However, other materials may be used and the shape may vary both as to size and geometric configuration. Preferably, the drainer has feet, ramps or other structural components to space the bottom of the drainer above the tray with which it will be used, to allow items placed within the drainer to drip onto the tray.

Second, the size and structural features of the tray can also vary widely, it being necessary only that the tray have a footprint which is larger than the bottom of the drainer with which it will be used. The tray preferably is inclined so that it can empty into a sink and may have various decorative features (for example ribs) or other structural or aesthetic components. The tray also will typically have some type of rim around its outer periphery to keep water collected by the tray flowing toward the sink rather than spilling onto the counter or floor.

Third, the materials used to construct the tray are also preferably synthetic resins. For one embodiment, it is necessary that the tray be made from a material which may be rolled up easily, while in the other illustrated embodiment, where live hinges are used, a more rigid tray material may be employed. However, it should be appreciated that the folding embodiment may employ construction materials which are rigid or flexible.

Figure 4:
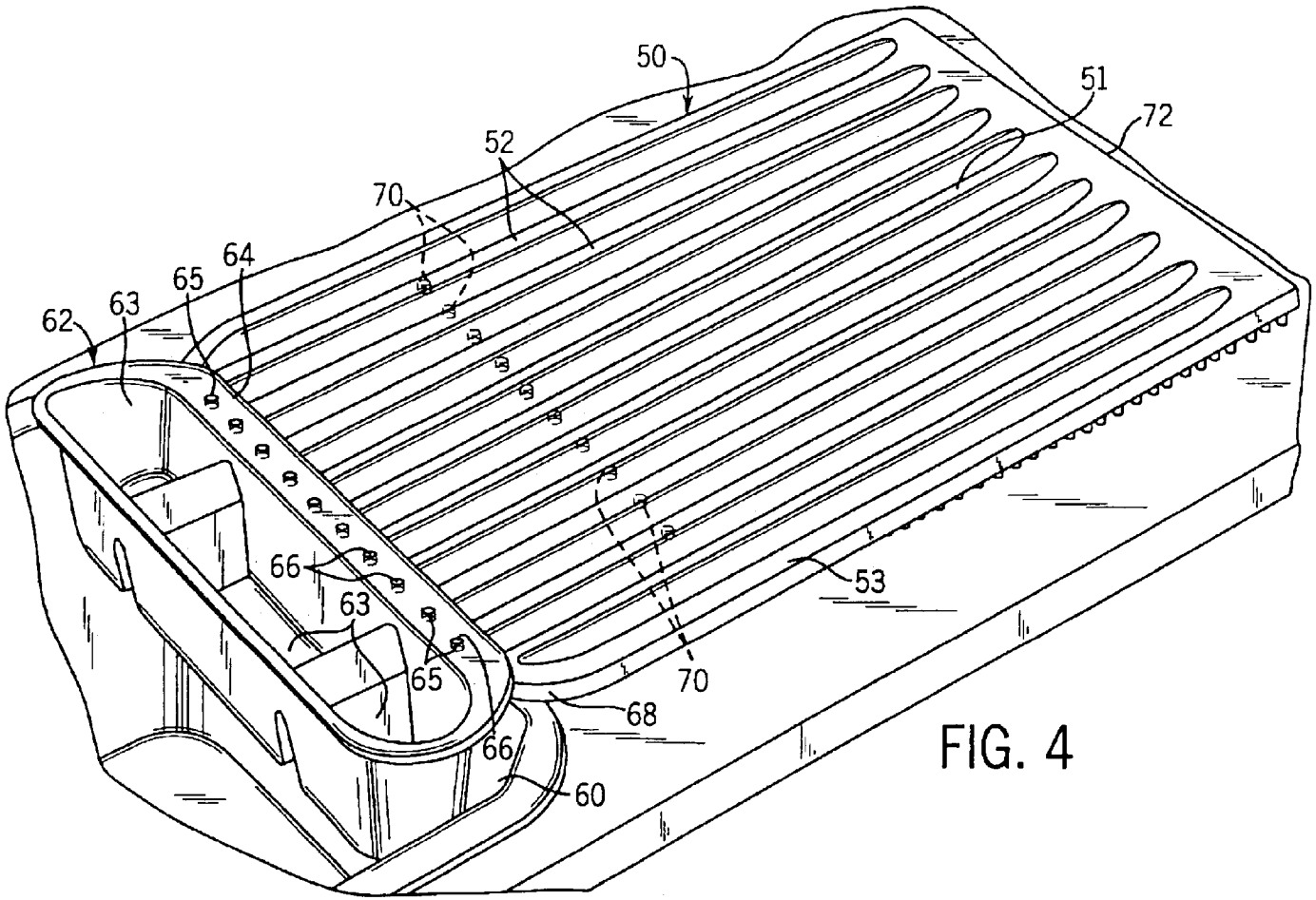
FIG. 4 is a perspective view of a different tray and a detachable silverware container.

Fourth, the detachable silverware component which is shown in FIG. 4 coupled to the rollable tray could also be used with the folding tray design without departing from the intended scope of the invention. Moreover, either tray may be used without any auxiliary components, such as the silverware container.

Fifth, the particular number of rolls to attain a compacted size, or the number of folds used with a foldable tray, can vary from those shown in the illustrated embodiments.

Finally, the foldable and rollable trays disclosed and claimed herein may be used without a separate drainer, for example where only a few items may require drying or where the geometry of the washed item does not easily fit within the drainer. The reduced sized storage benefits for the tray itself are deemed to be a separate feature of the present invention.

Figure 1:
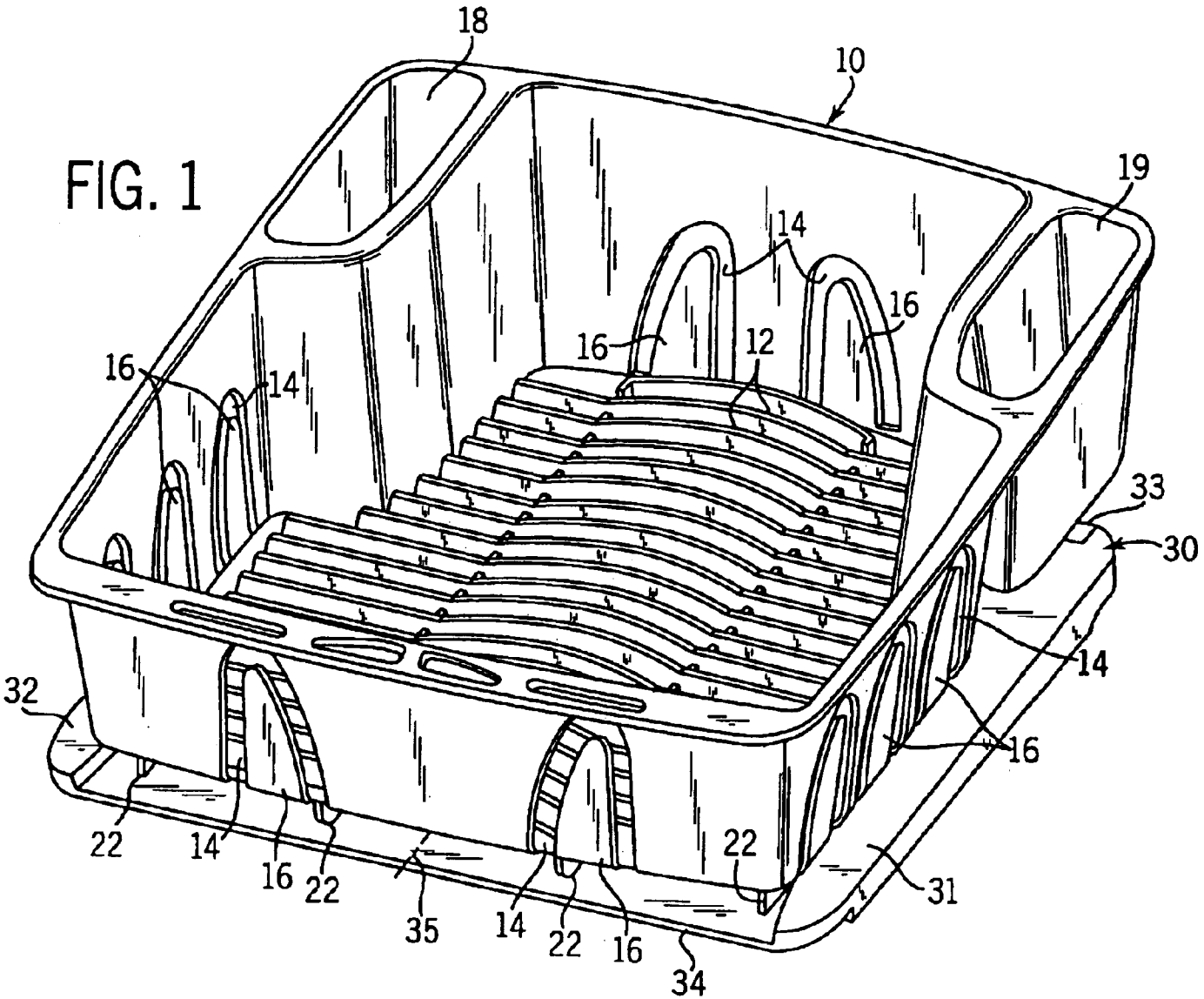
FIG. 1 is a perspective view of a dish drainer and tray according to one preferred embodiment of the present invention.

Proceeding now to a description of the detailed embodiments, FIG. 1 shows an illustrative dish drainer 10 to be generally rectangular or square in horizontal cross section. A plurality of ribs 12 are provided and extend upwardly from the bottom of drainer 10 and serve to hold plates, bowls or other kitchenware in a vertical orientation within the drainer. A plurality of apertures 14 are provided about the perimeter of drainer 10, each having an internal flap 16, over which a glass can be placed. The illustrated drainer of the first embodiment also includes a pair of compartments 18 and 19 which could be used for cooking utensils, silverware and the like. Drainer 10 includes a slotted or perforate base so that items placed in the drainer 10 may drip through the drainer onto the tray soon to be described. In the illustration of FIG. 1, four elongated ramps 22 extend from the forward portion of the drainer toward the rear portion thereof to suspend the bottom of the drainer above the surface upon which it will be placed. This ensures that items placed in the drainer are free to release water droplets onto a lower surface than the bottom of drainer 10.

As mentioned previously, this drainer 10 is for purposes of illustration and should not be taken as limiting. However, it serves well to illustrate the features of the invention which will become apparent as the description of the preferred embodiments continues.

Figure 2:
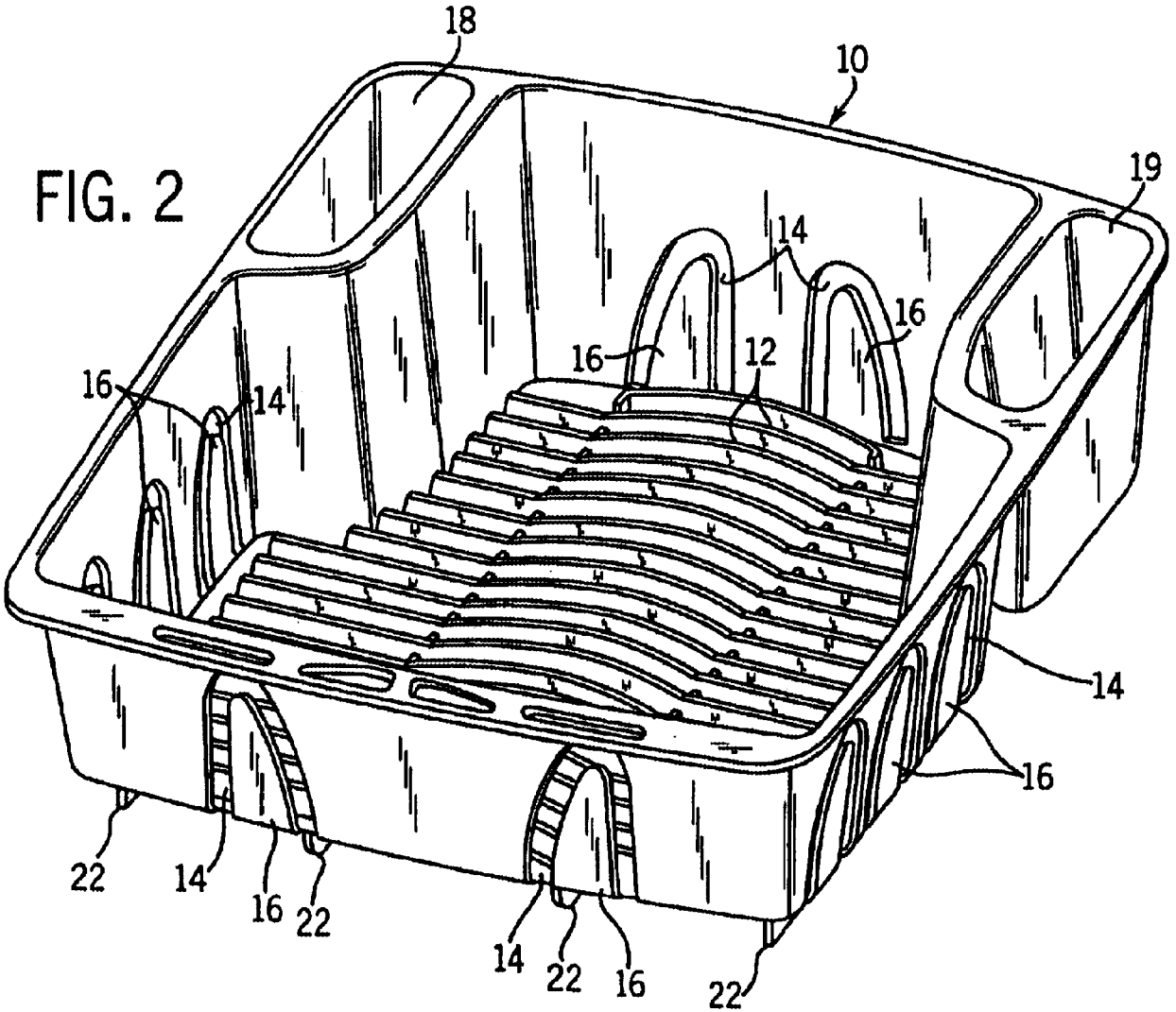
FIG. 2 is an exploded perspective view of the dish drainer and tray shown in FIG. 1 with a silverware container.
Figure 3:
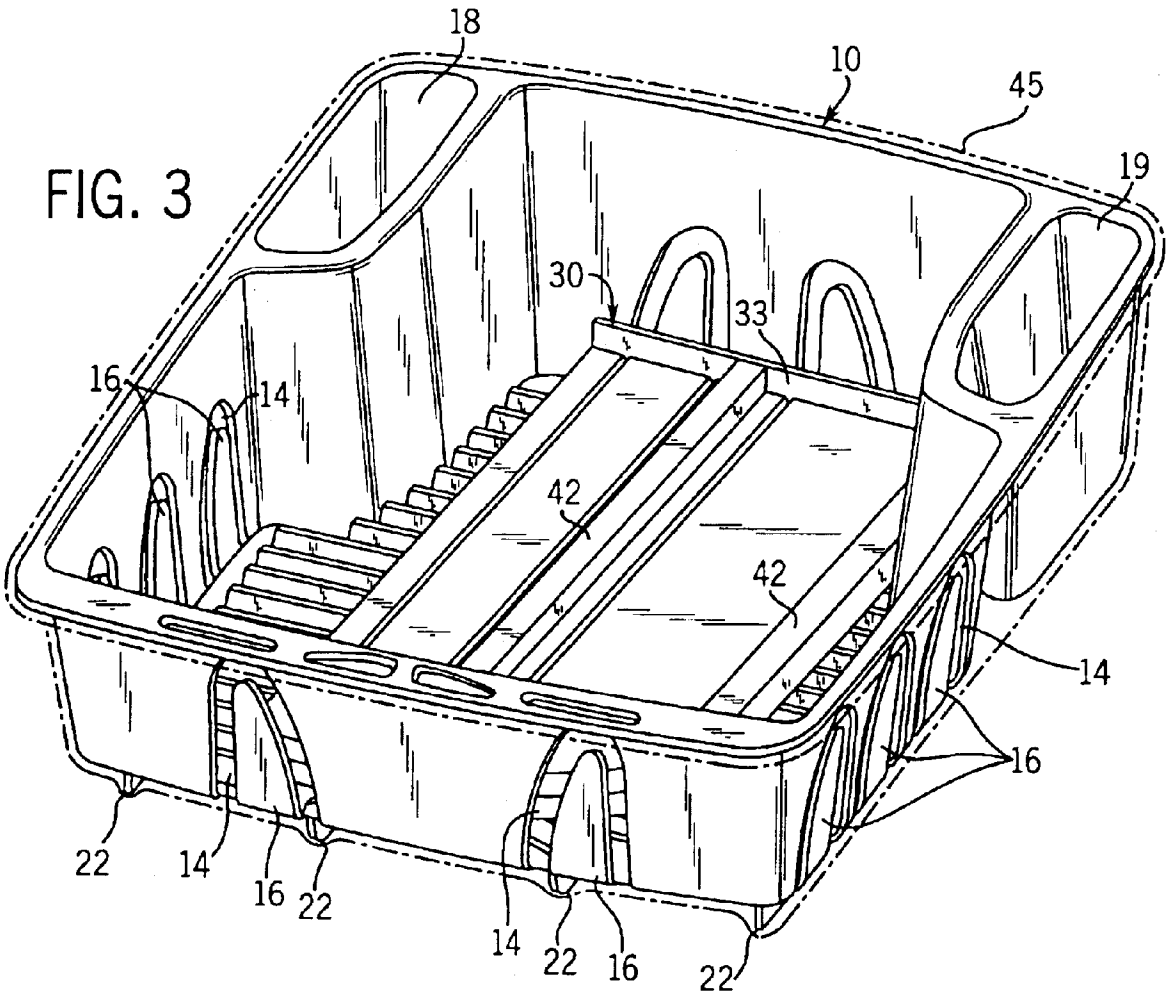
FIG. 3 is a perspective view of the drainer and tray of FIG. 1, with the tray in its storage configuration and a package surrounding the set and shown in phantom.

FIG. 1 also shows a tray 30 suitable for use with drainer 10. Tray 30 has a footprint which is larger than the base of drainer 10 and includes raised side edges 31 and 32 and a raised rear edge 33 to contain water falling onto the tray from drainer 10. The tray 30 is inclined to direct water toward a front edge 34. Tray 10 also includes a live hinge 35 extending from the forward edge 34 to the rear edge 33. The hinges allow tray 30 to be folded into a compact size for storage within drainer 10. The tray is illustrated in FIG. 2 in its deployed position without drainer 10, and FIG. 3 shows a combination of the tray 30 folded about the hinge 35 and located within drainer 10. Ribs 42 which are not visible in FIG. 1 or 2 are shown in FIG. 3 and the extend from front edge 34 to rear edge 33 to incline the tray 30 for discharging its contents into a sink or other receptacle. A package 45 is shown in phantom in FIG. 3 and can be any suitable shipping and/or display package, including folding carton, corrugated or plastic film packages or combinations thereof.

A second embodiment of the invention is shown in FIG. 4 where a roll-up dish drainer tray 50 is illustrated. It is generally flat with a plurality of longitudinal ribs 52 on its upper surface and a raised rim 53 surrounding the upper surface 51. This tray 50 is also inclined toward the left as shown in this prospective view, so that the contents of the tray may empty into the sink 60 partially illustrated here. Also shown in FIG. 4 is a selectively detachable silverware compartment 62 having chambers 63 into which silverware can be placed and a flange 64 extending along one edge. The flange includes a plurality of pegs holes 65 which are arranged and constructed to receive pegs 66 extending upwardly from the forward edge 68 of tray 50. The tray functions to discharge water from either the silverware compartment or the tray surface into the sink 60. Once detached, silverware compartment 62 allows tray 50 to be rolled for storage. Furthermore, the pegs 66 are arranged and adapted to enter lock holes 70 located along the underside of tray 50 as shown in phantom in FIG. 4. When the rear edge 72 of tray 50 is rolled toward edge 68 (the rolling taking place by turning edge 72 underneath the upper surface 51 of tray 50 and continuing the holes 70 of the tray 50 are aligned with the pegs 66 to permit locking the tray in its rolled position.

Figure 5:
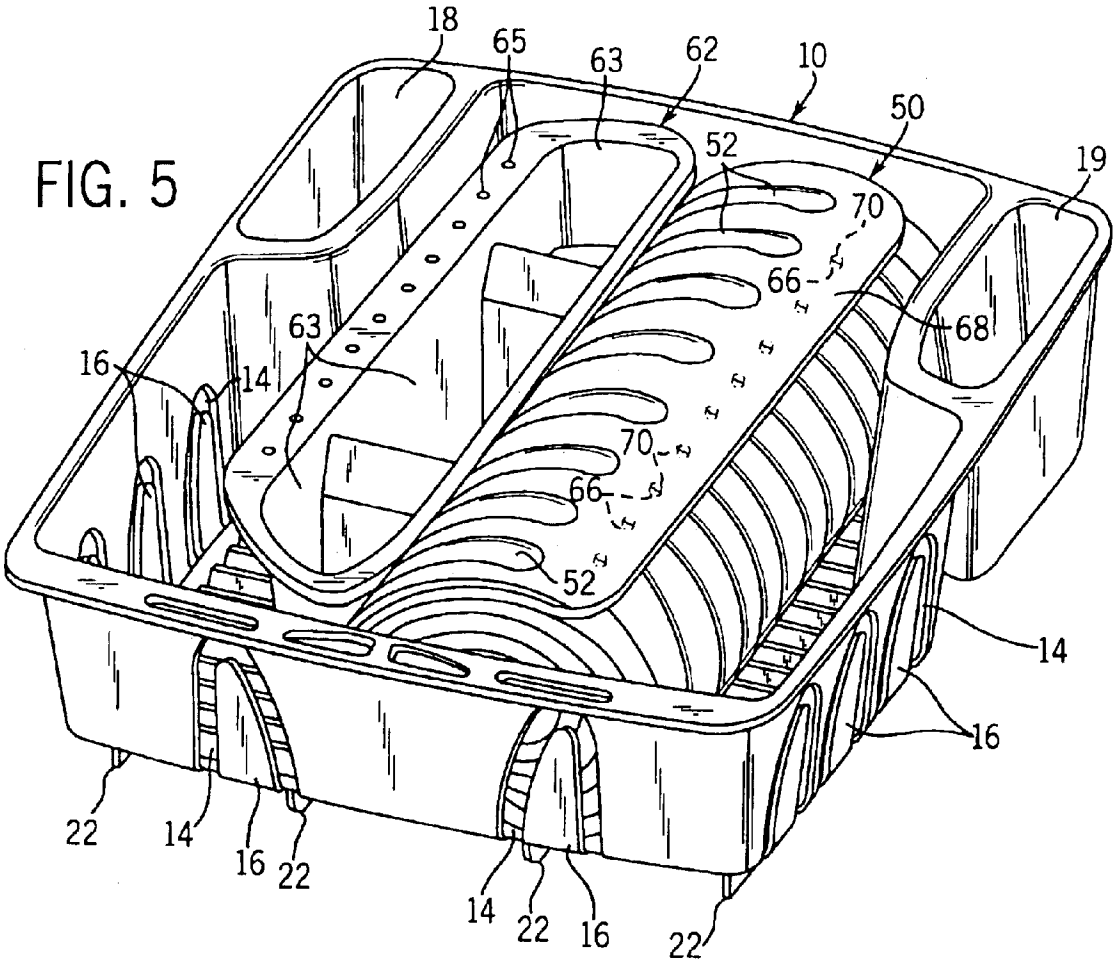
FIG. 5 is a perspective view of the tray and container of FIG. 4, with the tray in its storage configuration and both within the drainer of FIG. 1.

FIG. 5 illustrates how both the rolled tray 50 and the silverware compartment 62 can fit within the drainer 10 shown in FIGS. 1 and 3. For emphasis, it can again be pointed out the drainer is shown for illustrative purposes only, and that when using a separate silverware container, the drainer may not require separate compartments such as those illustrated by reference numbers 18 and 19 in FIG. 1.

Other ways may be used to hold a rolled tray in a rolled configuration, such as the use of straps, Velcro® closure materials and the like, but it is believed that the peg and hole technique is advantageous from a cost molding, manufacturing and sanitation standpoints.

While the present invention has been described in connection with two different embodiments, the invention is not to be limited thereby but is to be limited solely by the scope of the claims which follow.

What is claimed is:

1. A dish drainer and tray set comprising:

a dish drainer having a perforate base and a perimeter wall extending upward from the base, the perimeter wall and base defining an interior of the dish drainer;

at least one compartment formed contiguous with the perimeter wall and extending within the interior;

a discrete water collecting tray having a footprint larger than the base of the dish drainer when the water collecting tray is in a first deployed configuration, the discrete water collecting tray being positionable substantially beneath the base of the dish drainer;

the discrete water collecting tray being compactable to a second storage configuration and positionable entirely within the interior of the dish drainer when the water collecting tray is in the second storage configuration; and a silverware compartment which is readily detachable from or attachable to the water collecting tray.

2. The set of claim 1, wherein the silverware compartment includes first locking components and the water collecting tray includes second locking components, the silverware first and second locking components being locked together when the silverware compartment is attached to the water collecting tray.

3. The set of claim 2 wherein one of the first and second locking components is a plurality of pegs and the other of the first and second locking components is a plurality of holes sized to receive the pegs.

4. The set of claim 1 wherein the silverware compartment is sized to fit entirely within the drainer interior when the water collecting tray is in the storage configuration.

5. The set of claim 1 wherein the tray is flexible and is rolled up to convert from the first deployed configuration to the second storage configuration.

6. The set of claim 5 wherein the tray is made from a synthetic resin.

7. The set of claim 5 wherein the tray includes a lock for maintaining the tray in the second storage configuration.

8. The set of claim 7 wherein the tray has an upper surface and a lower surface and the lock comprises a plurality of pegs on one of the surfaces and a plurality of holes on the other of the surfaces located so that the pegs and holes are aligned when the tray is in the second storage configuration and the pegs are inserted into the holes.

9. The set of claim 1 wherein the water collecting tray includes at least one hinge and is folded about the hinge when the water collecting tray is converted from the first deployed to the second storage configuration.

* * * * *

UNITED STATES PATENT AND TRADEMARK OFFICE

CERTIFICATE OF CORRECTION

PATENT NO. : 6,763,954 B1
DATED : July 20, 2004
INVENTOR(S) : Travers et al.

It is certified that error appears in the above-identified patent and that said Letters Patent is hereby corrected as shown below:

Column 6,
Line 3, delete "claim 1," and insert -- claim 1 --.
Lines 5-6, delete "silverware first and second" and insert -- first and second --.

Signed and Sealed this

Twelfth Day of April, 2005

JON W. DUDAS
*Director of the United States Patent and Trademark Office*